United States Patent [19]

Buzzichelli et al.

[11] 4,449,634

[45] May 22, 1984

[54] HOISTING ASSEMBLY WITH A BOOM AND A COUNTERWEIGHT HAVING ADJUSTABLE RESPECTIVE POSITIONS

[75] Inventors: Lilian Buzzichelli; Kléber Roy, both of Toulouse, France

[73] Assignee: Enterprises Buzzichelli, L'Union, France

[21] Appl. No.: 280,315

[22] Filed: Jul. 6, 1981

[30] Foreign Application Priority Data

Jul. 4, 1980 [FR] France ..... 80 14991

[51] Int. Cl.[3] ..... B66C 23/72

[52] U.S. Cl. ..... 212/196; 212/211

[58] Field of Search ..... 212/195–198, 212/211, 191, 232, 239, 255, 262

[56] References Cited

U.S. PATENT DOCUMENTS

| | | | |
|---|---|---|---|
| 2,846,081 | 8/1958 | Moore | 212/211 |
| 3,653,486 | 4/1972 | McLean et al. | 212/196 |
| 3,955,844 | 5/1976 | De Castella et al. | 212/195 |
| 4,032,016 | 6/1977 | Graf | 212/196 |
| 4,155,163 | 5/1979 | Schwartz . | |
| 4,155,463 | 5/1979 | Buzzichelli et al. | 212/196 |
| 4,220,246 | 9/1980 | Ray | 212/198 |

FOREIGN PATENT DOCUMENTS

| | | | |
|---|---|---|---|
| 878062 | 7/1949 | Fed. Rep. of Germany | 212/198 |
| 1413966 | 11/1965 | France | 212/196 |
| 596613 | 8/1959 | Italy | 212/195 |
| 1110475 | 4/1968 | United Kingdom | 212/197 |

*Primary Examiner*—Trygve M. Blix
*Assistant Examiner*—Stephen P. Avila
*Attorney, Agent, or Firm*—Cushman, Darby & Cushman

[57] ABSTRACT

A hoisting assembly comprising a boom and a counterweight support extending in opposite directions and forming an assembly pivotally mounted on a supporting member for pivoting in a same vertical plane, adjustable connecting device interconnecting the boom and the counterweight being provided for selectively adjusting the respective positions of the boom and of the counterweight. The counterweight may be slidingly mounted on a prolongation portion of the main portion of the boom.

3 Claims, 6 Drawing Figures

HOISTING ASSEMBLY WITH A BOOM AND A COUNTERWEIGHT HAVING ADJUSTABLE RESPECTIVE POSITIONS

BACKGROUND OF THE INVENTION

1. Field of the Invention

The present invention relates to a hoisting assembly and, more particularly, to a hoisting crane having a boom and a counterweight arm.

2. Description of the Prior Art

U.S. Pat. No. 4,155,463 discloses a hoisting assembly for hoisting loads comprising a boom and a counterweight support extending in opposite directions and pivotally supported on a supporting means for pivoting in a same vertical plane and interconnected by means of adjustable connecting means allowing their relative position to be changed, said boom and said counterweight support building a pendular assembly which may take a balance position whatever the load carried by the boom is. The content of said patent is incorporated here for reference.

OBJECT OF THE INVENTION

It is an object of the present invention to provide an improved hoisting assembly of the above considered class having a simplified and non-bulky configuration which is reliable and is more particularly for use in handling equipments for workshops or warehouses or as automotive cranes.

SUMMARY OF THE INVENTION

In order to meet this object and others, there is provided a hoisting assembly having a load suspending boom and a counterweight supported on a main support means to realize a pendular assembly idly swingable about a horizontal swing axis on said main support means, adjustable connecting means for controllably displacing the boom and the counterweight one relative to the other, the counterweight support being comprised by a single girder structure extending from the vicinity of the swing horizontal axis, the connecting means interconnecting the boom and the counterweight.

According to another feature of the invention, the counterweight is slidably displaceable with respect to the boom in a direction substantially along the main longitudinal axis of the boom.

Other objects and advantages will appear from the ensuing description and drawings in which:

DETAILED DESCRIPTION OF THE DRAWINGS

Figure 1:
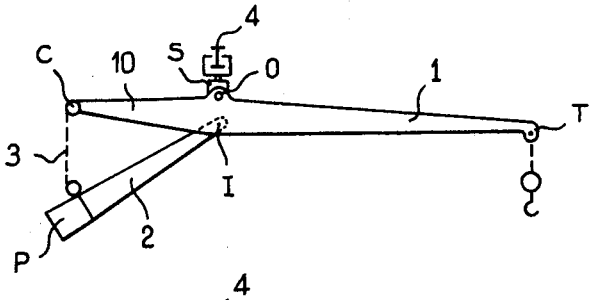
FIG. 1 illustrates schematically a first embodiment of a hoisting assembly according to the invention.

In the following description, identical or similar elements are identified by the same reference numerals or letters.

Referring to FIG. 1, there is shown a hanging hoisting assembly comprising a boom 1 having a unitary structure which is suspended about a horizontal swing axis O formed on an intermediary support structure S which is in turn slidably suspended below a monorail 4 forming the main support structure for the assembly. The counterweight P extends in a direction opposite to that of the boom 1 with respect to the pendular swing axis O and is carried at the end of a counterweight-support 2 having the form of a unitary girder structure which is directly hingedly supported at its inner end on the boom 1 at point I, adjacent the swing axis O. The boom 1 is prolongated in the direction opposite to its load suspending end T by an extension portion 10 extending in the same direction with respect to the general swing axis O as the counterweight support 2. Controlled and adjustable connecting means 3, for instance a combination cables/pulleys-trolleys, interconnect the distal end C of the extension portion 10 of the boom 1 and the counterweight P to achieve a selective adjustment of the respective angular position of the boom and of the counterweight, for instance depending on the loads suspended on the boom. Convenient usual means (not illustrated) are provided for lifting or descending the suspended loads.

Figure 2:
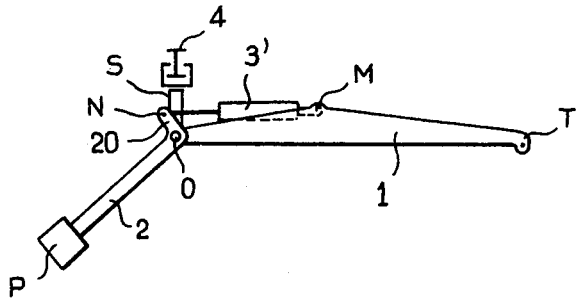
FIG. 2 illustrates an alternative embodiment of the assembly shown in FIG. 1.

In the embodiment illustrated in FIG. 2, the boom 1 also has a unitary compact structure and has its end opposite to the load suspending end thereof T directly connected to the general horizontal swing axis O. The counterweight support 2 is similarly directly hingedly supported by its inner end on said swing axis O and comprises, adjacent said axis O, a leg portion 20 extending perpendicularly upwardly with respect to the main girder section of the counterweight support 2. The adjustable connecting means 3' here comprises a cylinder means interconnecting the distal end N of the leg portion 20 of the counterweight support and an upper intermediary point M of the boom 1.

Figure 3:
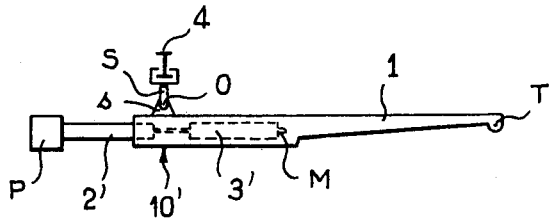
FIG. 3 illustrates another embodiment of a hoisting assembly according to the invention.

In the embodiment illustrated in FIG. 3, the boom 1 has its main portion opposite to the load suspending end T realized in the form of an elongated hollow beam 10' hingedly connected to the general swing axis O by upwardly extending flanges s. In the hollow beam portion 10' is slidably received the elongated counterweight support 2' comprised by a straight rigid structure extending coaxially to said hollow beam portion 10' of the boom 1. The adjustable connecting means 3', of the cylinder type, is received within the hollow beam portion 10' and interconnect an intermediary median point M of the boom 1 and the inner end of the counterweight support 2' so as to selectively allow to-and-fro displacement of the counterweight P towards or apart from the swing axis O with the counterweight support girder 2' sliding within the hollow beam portion 10'.

Figure 4:
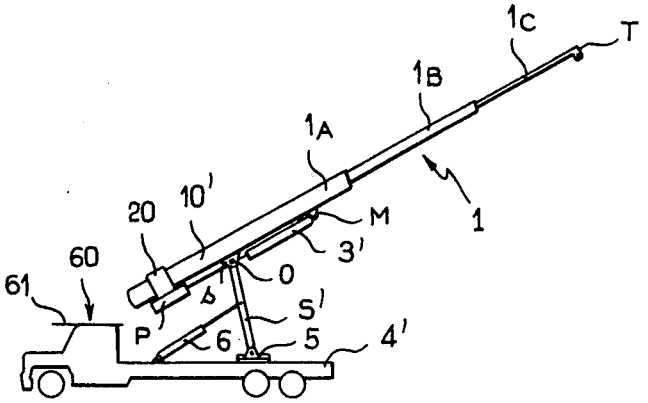
FIG. 4 illustrates a combination hoisting assembly automotive vehicle.

There is illustrated in FIG. 4 a telescopic crane assembly mounted on a vehicle 6, which can be a trailer, an automotive vehicle, a barge or a boat. The main structure $1_A$ of the telescopic boom 1 consists, as in the embodiment of FIG. 3, in a hollow beam section 10' which is here prolongated beyond the general swing axis O in a direction opposite to the load suspending end T of the boom so as to realize itself the support structure for supporting and guiding the counterweight P which is slidably mounted on said boom section 10', for instance by means of a rolling carriage 20. The adjustable connecting means 3', of the cylinder type, extends along a side, e.g. the lateral side, of the main boom section $1_A$ between an intermediary point M of the boom 1 and the counterweight P. As shown in the drawing, the boom further comprises additional telescopic boom sections $1_B$ and $1_C$, the end section $1_C$ being terminated by the load suspending end T. The boom includes power means, e.g. jacks (not illustrated), for controllably extending or retracting the telescopic boom sections and, as in the other embodiments, power means for lifting suspended load (also not illustrated). Additionally, in a preferred embodiment, the main section $1_A$ of the boom is hingedly supported by downwardly extending flanges s on the upper end of a support strut S' which is in turn hingedly supported, at its lower end 5, on the platform 4' of the vehicle 60. The angular displacement of the support strut S' is controlled by a cylinder 6 so to allow a road transport configuration, with the support strut S' downwardly turned down toward the platform 4' and the boom 1 in its retracted configuration supported on a convenient supporting structure 61 of the vehicle.

Figure 5:
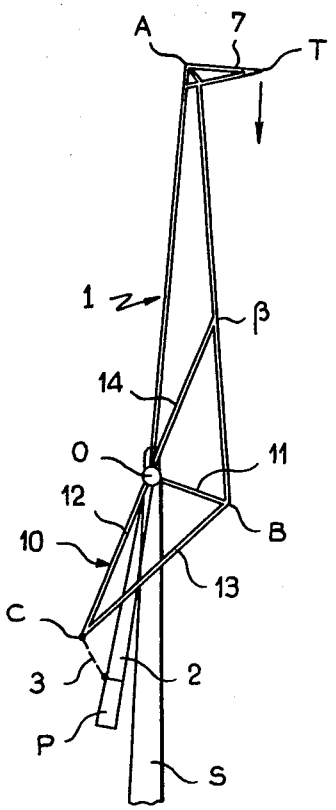
FIGS. 5 and 6 illustrate a hoisting assembly of the crane type having superstructures supported on a mast.
Figure 6:
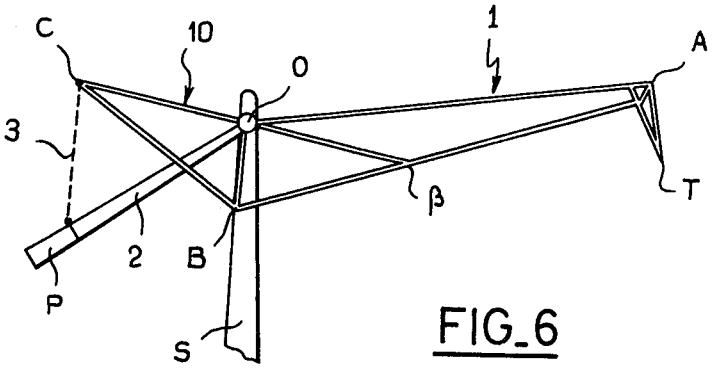

FIGS. 5 and 6 illustrate two extreme angular positions of a crane assembly suspended on the top of a double mast S which is in turn pivotally supported at its bottom end (not illustrated) so as to selectively rotate around a vertical axis. In said embodiment, the boom 1 has a great span and consists in a trussed structure having one end portion 10 opposite to the load suspending end portion T prolongating beyond the horizontal swing axis O in the same direction as the counterweight support 2 which is in the form of a substantially straight girder structure hingedly supported by its inner end to the mast S on the swing axis O. More specifically, the proper boom portion is comprised by the structure OBA which is prolongated at its distal end by a perpendicularly downwardly extending nose 7, a wind-brace interconnecting the swing axis O and an intermediary point of the linking structure AB, a windbrace 11 interconnecting the lowermost point B of the boom to the pivot or swing axis O. The trussing members 12 and 13 of the opposite end 10 of the boom prolongate beyond the points O and B to converge outwardly toward the distal end C of said opposite portion 10 of the boom 1. The adjustable connecting means, for instance a combination cables/pulleys, interconnect said distal end C and the counterweight P. Said crane arrangement, of a particularly simple configuration, authorizes a wide range of span variations of the boom 1, as appearing from FIGS. 5 and 6.

While the present disclosure has been made in relation with particular embodiments, it is to be understood that modifications and changes may be resorted to, within the scope of the appended claims, without departing from the spirit of the invention.

What we claim is:

1. A hoisting assembly for hoisting loads, comprising:

a boom for suspending loads having a main portion having a longitudinal axis and a load suspending end; said load suspending end having means for suspending a load;

a counterweight;

a counterweight support extending in a generally opposite direction from said boom while in the same vertical plane as said boom and supporting said counterweight; and adjustable connecting means interconnecting said boom and said counterweight, said connecting means being adjustable independently of said means for suspending a load, said boom and said counterweight support being idly mounted on a main support so as to constitute with said connecting means a pendular assembly adapted to freely swing about a horizontal swing axis, said boom including an extension having substantially the same longitudinal axis as the main portion of said boom, said extension being located on the same side as said counterweight with respect to said horizontal swing axis, said boom and said counterweight support being supported about said horizontal swing axis so that the angular relationship therebetween may be selectively modified by said connecting means extending between said counterweight and the end of said extension of said boom.

2. The hoisting assembly as claimed in claim 1 wherein said boom is suspended on said main support.

3. The hoisting assembly of claim 2 wherein said main support is a monorail.

* * * * *